US011731191B2

(12) United States Patent
Hersche et al.

(10) Patent No.: US 11,731,191 B2
(45) Date of Patent: Aug. 22, 2023

(54) DIE CASTING MACHINE WITH ENERGY FRAME

(71) Applicant: BÜHLER AG, Uzwil (CH)

(72) Inventors: Lukas Hersche, St. Gallen (CH); Dominik Widler, Kreuzlingen (CH); Beat Eberle, Wallisellen (CH)

(73) Assignee: BÜHLER AG, Uzwil (CH)

( * ) Notice: Subject to any disclaimer, the term of this patent is extended or adjusted under 35 U.S.C. 154(b) by 0 days.

(21) Appl. No.: 17/595,222

(22) PCT Filed: Mar. 25, 2020

(86) PCT No.: PCT/EP2020/058382
§ 371 (c)(1),
(2) Date: Nov. 11, 2021

(87) PCT Pub. No.: WO2020/229034
PCT Pub. Date: Nov. 19, 2020

(65) Prior Publication Data

US 2022/0212248 A1 Jul. 7, 2022

(30) Foreign Application Priority Data

May 14, 2019 (EP) ..... 19174312

(51) Int. Cl.
*B22D 17/26* (2006.01)
*B22D 17/22* (2006.01)

(52) U.S. Cl.
CPC ..... *B22D 17/26* (2013.01); *B22D 17/22* (2013.01)

(58) Field of Classification Search
CPC ..... B22D 17/26; B22D 17/22
See application file for complete search history.

(56) References Cited

U.S. PATENT DOCUMENTS

2001/0035277 A1 11/2001 Macheske et al.

FOREIGN PATENT DOCUMENTS

| | | | |
|---|---|---|---|
| CN | 203110289 | U | 8/2013 |
| CN | 203465837 | U | 3/2014 |
| CN | 105564021 | A | 5/2016 |
| JP | 2001191381 | A | 7/2001 |

*Primary Examiner* — Kevin P Kerns
*Assistant Examiner* — Steven S Ha
(74) *Attorney, Agent, or Firm* — Colson Law Group, PLLC.

(57) ABSTRACT

The present invention relates to a die casting machine including at least one receiving frame for energy modules (4A, 4B, 4C, 4D, 4E, 4F), wherein the receiving frame has fastening means (5A, 5A') for fastening the receiving frame on the die casting machine and 1 to 3 rows (5H, 5H', 5H") for receiving energy modules (4A, 4B, 4C, 4D, 4E, 4F).

15 Claims, 4 Drawing Sheets

(prior art)

DIE CASTING MACHINE WITH ENERGY FRAME

The present invention relates to a die casting machine having a receiving frame for receiving energy modules.

Die casting machines are sufficiently known (see, for example, Brunhuber, Praxis der Druckgussfertigung, Berlin, 3rd edition 1980). In a die casting machine, a mold consisting of two halves is closed under high pressure, molten metal (or a metal alloy) is introduced into the closed mold, and after the casting material has solidified, the finished die casting can be removed by opening the mold. The mold halves are arranged on a fixed and a movable platen, and the mold is closed by corresponding movement of the movable platen on guide columns towards the fixed platen.

For the operation of the casting mold of a die casting machine, it is necessary for energy modules to be provided on the die casting machine in order to supply the corresponding components of the die casting machine with electrical energy or hydraulic medium. Usually, these energy modules are arranged in defined unoccupied areas of the fixed and/or movable platen.

Figure 1:
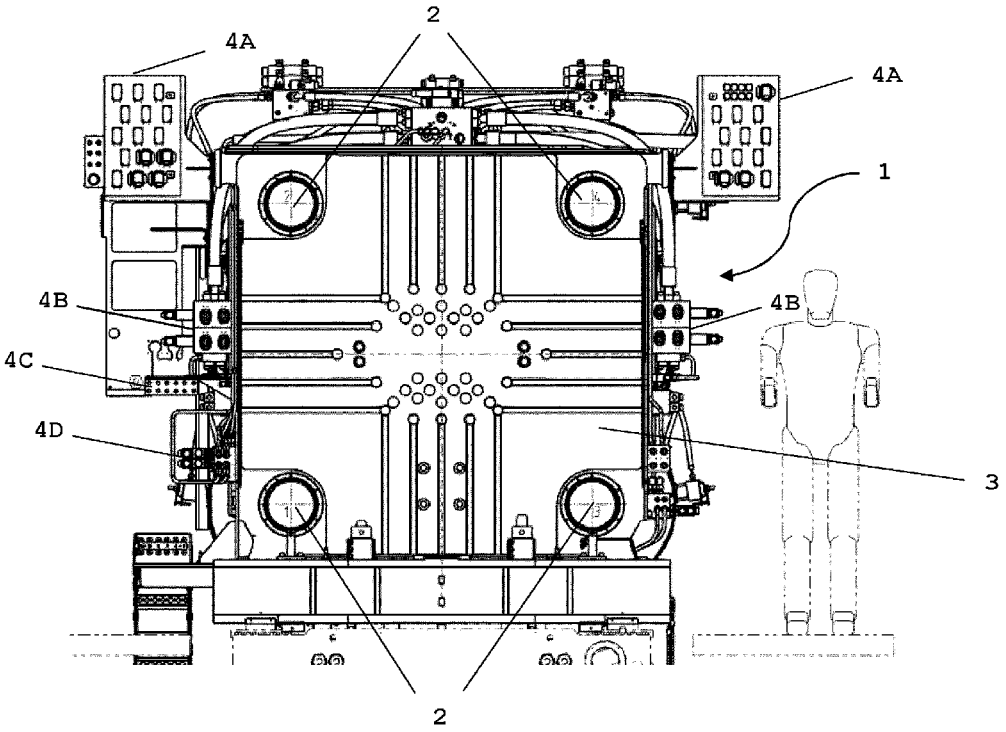

FIG. 1 schematically shows a front view of a die casting machine from the prior art. The die casting machine 1 comprises a (here, by way of example, fixed) platen 3 and openings 2 in the platen 2 for guide columns (not shown) for moving a movable platen (not shown). Modules 4A for supplying the die casting machine with electrical energy, modules 4B for operating core pullers, a module 4C for cooling and a module 4D for operating a booster are arranged on the sides of the platen 2.

The areas available for the modules are small and can generally be used only for the corresponding module hut not for other energy modules. The arrangement of the areas for the energy modules depends on the type of die casting machine, i.e., on the spaces available at a specific die casting machine. In FIG. 1, for example, the modules 2 for supplying the die casting machine with electrical energy can be arranged only very high up due to their size, which is why they can only be accessed with difficulty by a schematically illustrated user.

A modification of a conventional die casting machine is bound up with considerable effort, since additional required energy modules can only be arranged, if at all, in the few remaining unoccupied areas of the die casting machine. Due to the space problem and the already existing cabling or supply using hoses, already existing energy modules can be relocated only with great effort, if at all.

A modification to a different machine size is bound up with considerable effort, since each machine size has different interfaces.

US-2001/0035277 A1 proposes to operate several injection-molding units via common energy modules. However, this solution is obviously unsuitable for bulky die casting machines, since it takes up an enormous amount of space and, moreover, a plurality of die casting machines is not usually operated with sufficient mutual proximity.

It was the object of the present invention to provide a die casting machine that requires little space and is easy to retrofit.

This object is achieved by a die casting machine according to Claim 1.

In detail, the present invention relates to a die casting machine comprising at least one receiving frame for energy modules, the receiving frame comprising:

fastening means for fastening the receiving frame on the die casting machine, 1 to 3 rows for receiving energy modules, wherein each row comprises two profile pieces which are connected to one another, preferably at their ends, by a connecting piece or an energy module, forming a quadrangular, preferably rectangular interior space, wherein the rows have means for arranging energy modules in their interior space and, if there is a plurality of rows, are connected to one another, and wherein the fastening means for fastening the receiving frame on the die casting machine are arranged on a profile piece forming an outer face of the receiving frame, and the receiving frame is fastened on the die casting machine via the fastening means, preferably forming an interspace between the die casting machine and the row adjacent to the die casting machine.

According to the invention, the die casting machine is preferably a two-platen die casting machine or a three-platen die casting machine.

The present invention is based on the concept of providing all energy modules necessary for the die casting machine in a receiving frame which is arranged on the die casting machine. This enables a particularly space-saving arrangement of the energy modules and very simple retrofitting of the die casting machine, should additional and/or other energy modules need to be provided. The space required for the energy modules is optimally used and kept as small as possible. In other words, the so-called "footprint" of the die casting machine is optimized.

The receiving frame has fastening means in order to be fastened on the die casting machine. The receiving frame is preferably fastened on a side face of one of the platens of the die casting machine, for example on the fixed or movable platen of a die casting machine, preferably on a side face of the movable platen. In the case of providing a plurality of receiving frames on a die casting machine, the receiving frames can be arranged on both the fixed and movable platen.

According to a preferred embodiment of the present invention, receiving frames are arranged symmetrically on both sides of the die casting machine, preferably on both sides of one or more platens of a die casting machine.

A die casting machine usually has a platform which can be reached by the operating personnel for example via steps, in order to reach the space in which the mold halves are arranged. According to a preferred embodiment of the present invention, the at least one receiving frame on the die casting machine is aligned with the platform height of the die casting machine. As a result, the energy modules arranged in the receiving frame are easily accessible to operating personnel on the platform. According to the invention, it is particularly preferred for the lower end of the receiving frame to be located 10-50 mm, in particular preferably 20-40 mm, above the floor of the platform.

The fastening means must be designed in such a way as to withstand the forces occurring during operation of the die casting machine and ensure a stable arrangement of the receiving frame on the die casting machine in all operating situations. With a die casting machine, it may become necessary, for example, to perform an emergency stop, in which case the movable platen must be stopped completely as quickly as possible. The fastening means must withstand the forces occurring in this case.

According to the present invention, the fastening means may be connecting pieces made of a sufficiently strong material, for example a suitable metallic material, such as iron, steel or the like. The connecting piece preferably has a material thickness of 10-50 mm, particularly preferably 10-20 mm. The width of the connecting piece (i.e., the dimension between the lateral end of the receiving frame and the outer face of the die casting machine on which the receiving frame is fastened) is preferably 100-200 mm, particularly preferably 150-180 mm. The depth of the connecting piece (i.e., the dimension perpendicular to the height and parallel to this outer face of the die casting machine) is preferably 100-200 mm, particularly preferably 120-160 mm. In a preferred embodiment of the present invention, the fastening means may be T-shaped or designed as a hollow cuboid.

In a preferred embodiment of the present invention, the receiving frame has two fastening means which are arranged in an upper or lower quarter, preferably at the corners, of the lateral end of the adjacent row of the receiving frame described below, which row forms an outer face of the receiving frame, and which extend laterally from the row.

In a preferred embodiment of the present invention, the receiving frame is fastened on the die casting machine to form an interspace between the die casting machine and the row adjacent to the die casting machine. Since the fastening means have an above-described width, the receiving frame in this embodiment does not rest directly on the side face of the die casting machine, but an interspace is formed between the die casting machine and the receiving frame. This interspace can be used, for example, for arranging hoses or cables.

The receiving frame according to the invention is of modular design. It comprises 1 to 3 rows for receiving energy modules.

According to the present invention, each row comprises two profile pieces which are connected to one another, preferably at their ends, by a connecting piece or an energy module, forming a quadrangular, preferably rectangular interior space. The profile pieces form the lateral boundary of the rows and, in the state when installed on the die casting machine, are preferably arranged parallel to the plane of the outer face of the die casting machine on which the receiving frame is fastened. A slight deviation from an exactly parallel alignment with the outer face of the die casting machine is conceivable. However, the arrangement of energy modules in the rows of the receiving frame must not be impaired.

According to the present invention, a profile piece is a component with defined dimensions. The profile pieces are preferably elongated components made of a sufficiently strong material, for example a suitable metallic material, such as iron, steel or the like. Like the connecting pieces, the profile piece must withstand the forces occurring during operation of the die casting machine. In addition, the profile pieces must be able to carry the load of the energy modules that are fastened on them.

A profile piece preferably has a material thickness of 10-50 mm, particularly preferably 10-20 mm. The depth of the profile piece (i.e., the dimension perpendicular to the height and parallel to this outer face of the die casting machine) is preferably 100-300 mm, particularly preferably 150-200 mm. The height of the profile piece (i.e., the dimension parallel to the height of this outer face of the die casting machine) is preferably 1000-2000 mm, particularly preferably 1500-1900 mm.

In the receiving frame according to the invention, in each case two profile pieces are connected to one another by connecting pieces or by energy modules, for example by threaded connections. The connection is preferably made at the ends of the profile pieces, i.e., directly at the end of the profile pieces or at least in the respective last quarter of the height of the profile pieces. These connecting pieces correspond in terms of their design to the connecting pieces described above as fastening means, but preferably have a greater width so that conventional energy modules can be accommodated in the receiving frame. In a preferred embodiment of the present invention, these connecting pieces are made of a sufficiently strong material, for example a suitable metallic material, such as iron, steel or the like. Each connecting piece preferably has a material thickness of 10-50 mm, particularly preferably 10-20 mm. The width of each connecting piece (i.e., the dimension perpendicular to the outer face of the die casting machine on which the receiving frame is fastened) is preferably 100-300 mm, particularly preferably 200-270 mm. The depth of the connecting piece (i.e., the dimension perpendicular to the height and parallel to this outer face of the die casting machine) is preferably 100-200 mm, particularly preferably 120-160 mm. In a preferred embodiment of the present invention, the connecting pieces may be T-shaped or designed as a hollow cuboid.

In an alternative embodiment of the present invention, at least one fastening means may form an upper or lower connecting piece of the adjacent row. In other words, in this embodiment the fastening means extends not only from the outer face of the die casting machine to the profile piece of the adjacent row of the receiving frame closest to the die casting machine, but also to the profile piece of the adjacent row of the receiving frame further away from the die casting machine. In this case, the width of the corresponding fastening means/connecting piece is preferably 200-500 mm, particularly preferably 350-450 mm.

In an alternative embodiment of the present invention, a connection between two profile pieces can be realized by an energy module instead of by a connecting piece.

Each row comprises two profile pieces which are connected to one another to form a quadrangular, preferably rectangular, interior space. Conventional energy modules or energy modules specifically provided for this purpose can be arranged in this interior space. For this purpose, the rows have means for arranging energy modules in their interior space. These means can be, for example, drilled holes in the profile pieces for receiving screws, i.e., the energy modules in this case also have drilled holes in their side faces which can accommodate a screw. Alternatively, other means can also be provided on the profile pieces, for example supports or rails extending into the interior space of the row.

When a receiving frame according to the invention has a plurality of rows, they will be connected to one another. In this embodiment, the rows are connected either by connecting adjacent profile pieces to one another, for example by a threaded connection. However, adjacent rows preferably have a common profile piece. In other words, two adjacent rows share a profiled piece located between the rows. Each of the adjacent rows is then formed by connecting pieces extending from the common profile piece and in each case a further profile piece connected to these connecting pieces.

In a further embodiment of the present invention, the rows in the receiving frame according to the invention are arranged offset from one another in depth (i.e., the dimension perpendicular to the height and parallel to the outer face of the die casting machine on which the receiving frame is fastened). This means that the edges of the connecting pieces of rows, which are adjacent relative to each other, are offset relative to one another. This can be realized, for example, by two adjacent profile pieces being connected at an offset from one another, for example by a threaded connection. Alternatively and preferably, the connecting pieces on the different sides of a common profile piece of rows, which are adjacent relative to each other, can also be arranged offset from one another, for example by threaded connections. According to the invention, the rows in this embodiment are preferably offset from each other by a value of 10-100 mm, preferably 30-70 mm.

In a further embodiment of the present invention, it is provided that a common profile piece between adjacent rows does not extend over the entire height of the adjacent rows. For example, the profile piece may not be provided down to the lower end of the adjacent rows. As a result, the interior space in the corresponding lower region is expanded, since the interior spaces of the adjacent rows are not separated from one another there, but rather merge into one another. This makes it possible to arrange energy modules in the receiving frame which have a greater width than the width of a row of the receiving frame. It is also conceivable for a plurality of adjacent profile pieces to be designed analogously shorter and thus provide an even larger common region of the interior space.

In a further embodiment of the present invention, not all the rows of a receiving frame need to have the same height. It can preferably be provided that the row adjacent to the fastening means has a lower height than at least one further row.

In a further embodiment of the present invention, one or more cover elements can be arranged on the receiving frame. These may be metal sheets or covers which cover a portion of the interior space of the receiving frame or preferably a region along the side of, or below the receiving frame. A cover element can preferably be arranged on a lower connecting piece or laterally on a profile piece (preferably on a profile piece closing off the receiving frame) of a row. These cover elements are used for protection and are, for example, to prevent operating personnel from reaching areas of the die casting machine below or laterally past the receiving frame, where it would be dangerous to linger during operation of the die casting machine.

Energy modules within the meaning of the present invention are devices with which components of the die casting machine can be supplied with energy, for example in the form of electrical energy or in the form of a pressurized hydraulic medium, or with water, vacuum, compressed air, or hot oil. Such energy modules are conventionally known and available. They are basically box-shaped, have connections for supplying and discharging electrical current or hydraulic medium, and possibly operating elements, such as switches, control knobs, etc. The receiving frame according to the invention is provided for receiving known and available energy modules. However, it is of course also possible to provide specially developed energy modules in the receiving frame. The energy modules preferably have means for fastening in the receiving frame according to the invention, such as holes for receiving and fastening screws. Examples of energy modules that can be used are electrical devices, such as power distributors, transformers or rectifiers, or hydraulic devices, such as modules for operating an ejection cylinder, for operating core pull cylinders or booster cylinders, or for applying vacuum.

According to the invention, at least one energy module is arranged in a row of at least one receiving frame. Normally, however, a plurality of energy modules are required for operating a die casting machine, for example 5 to 15.

Normally, at least one energy module will be a device for operating hydraulic elements of the die casting machine. Particularly preferred according to the invention are energy modules for operating hydraulic elements of the die casting machine in a row of at least one receiving frame adjacent to the die casting machine. This is particularly advantageous due to the high dead weight of such energy modules and the hose connections to be provided.

In order to design the die casting machine as space-saving as possible, i.e., to optimize its "footprint", the energy modules should be arranged as close as possible to the die casting machine. In other words, an additional energy module should be arranged in a free region of an interior space of the receiving frame arranged as close as possible to the die casting machine. An interior space of a row further away from the die casting machine should not be fitted with energy modules until interior spaces arranged closer to the die casting machine are fully occupied. In this way, the number of required rows of the receiving frame can be kept as low as possible.

The present invention is explained in more detail below with reference to non-restrictive drawings. The following is shown:

FIG. 1 is a front view of a die casting machine from the prior art

Figure 2:
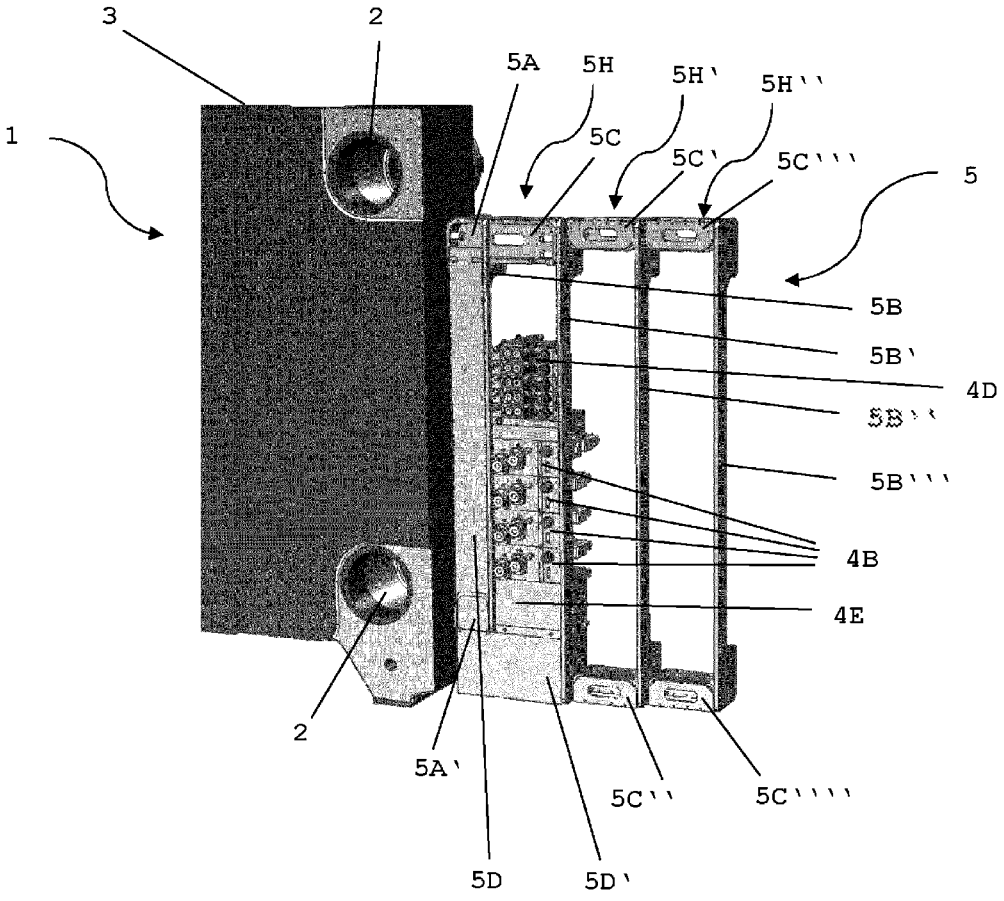
Figure 3A:
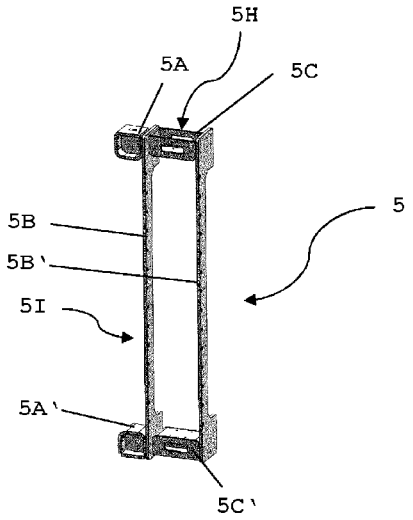
Figure 3B:
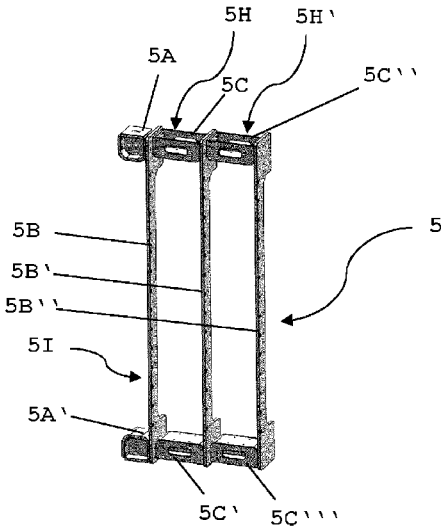
Figure 3C:
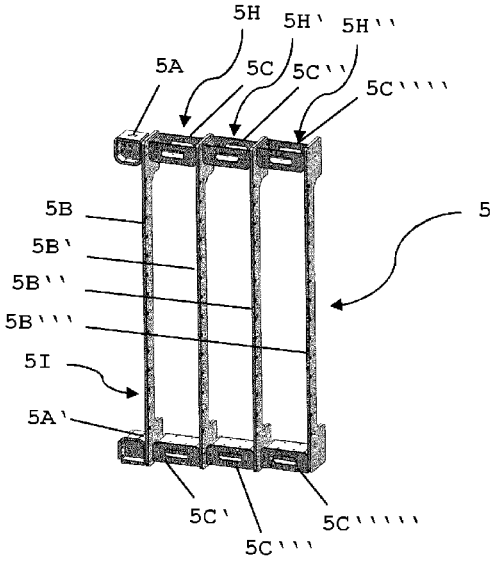
Figure 3D:
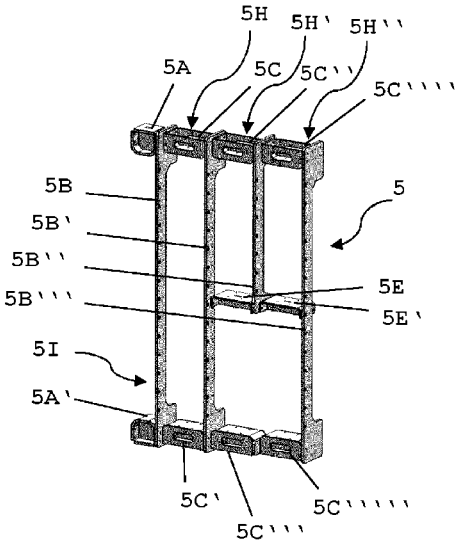
Figure 4:
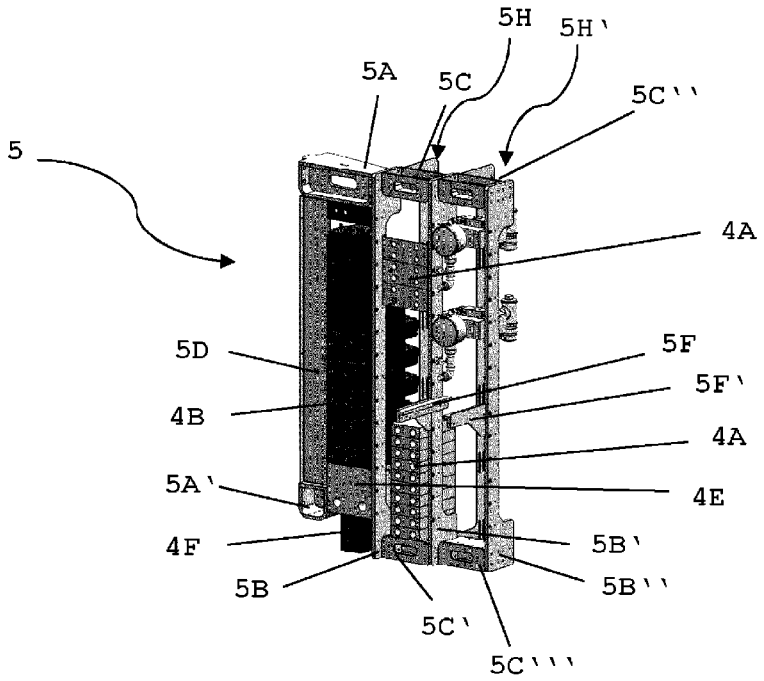
Figure 5:
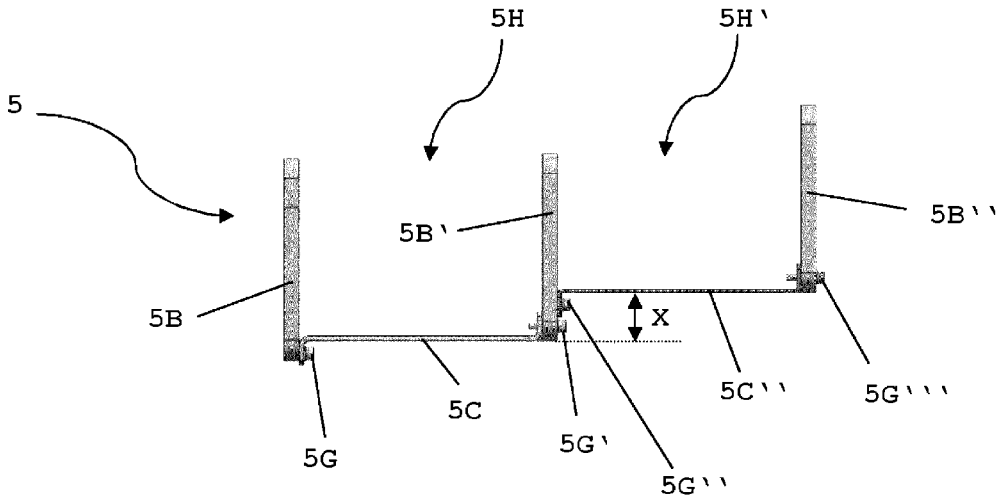

FIG. 2 is a schematic view of a receiving frame according to the invention that is fastened on a platen of a die casting machine FIG. 3A is a schematic view of an embodiment of a receiving frame according to the invention with one row FIG. 3B is a schematic view of an embodiment of a receiving frame according to the invention with two rows FIG. 3C is a schematic view of an embodiment of a receiving frame according to the invention with three rows FIG. 3D is a schematic view of an embodiment of a receiving frame according to the invention with three rows and a shortened profile piece FIG. 4 is a schematic view of an embodiment of a receiving frame according to the invention having extended fastening means FIG. 5 is a top view of an embodiment of a receiving frame according to the invention having offset rows In the drawings, the same reference signs designate the same components.

FIG. 1 schematically shows a front view of a die casting machine from the prior art. The die casting machine 1 comprises a (here, by way of example, fixed) platen 3 and openings 2 in the platen 2 for guide columns (not shown) for moving a movable platen (not shown). Modules 4A for supplying the die casting machine with electrical energy, modules 4B for operating core pullers, a module 4C for cooling and a module 4D for operating a booster are arranged on the sides of the platen 2. A platform with operating personnel standing thereon is schematically indicated.

FIG. 2 is a schematic view of a receiving frame 5 according to the invention that is fastened on a platen 3 of a die casting machine 1. Openings 2 for guide columns for moving a movable platen can be seen in the platen.

In this embodiment, the receiving frame 5 consists of three rows 5H, 5H', 5H", which are formed by the profile pieces 5B, 5B', 5B" and 5B"' as well as the connecting pieces 5C, 5C', 5C", 5C"' and 5C"".

The inner row 5H is delimited by the profile pieces 5B and 5B', which are connected to one another by the connecting pieces 5C and the energy module 4E (here, a base block of a hydraulic module stack). The fastening means 5A and 5A', via which the receiving frame 5 is connected to the platen 3, are arranged on the profile piece 5B. The fastening means 5A and 5A' are connected to the platen 3 and the profile piece 5B via screws (not shown).

An interspace 5I (not visible here) is formed between the fastening means 5A and 5A', which interspace 5I can be used for arranging hoses or cables and is closed towards the front in this embodiment by means of a cover element 5D (cover sheet).

Energy modules 4B, 4D and 4E are provided in the inner row 5H. In this embodiment, these are hydraulic modules, namely modules 4B for operating core pullers, modules 4D for operating boosters, and a base block 4E for distributing hydraulic medium between the other hydraulic modules. The energy modules 4B, 4D and 4E are fastened on the profile pieces 5B and 5B' of the inner row 5H by means of screws (not shown).

A middle row 5H' is delimited by the profile pieces 5B' and 5B", which are connected to one another by the connecting pieces 5C' and 5C". The inner row 5H and the middle row 5H' thus have a common profile piece 5B'. The connecting pieces 5C' and 5C" are fastened on the profile piece 5B' via screws (not shown) in a manner slightly offset to the rear. As a result, the middle row 5H' is arranged offset from the inner row 5H in the receiving frame 5.

An outer row 5H" is bounded by the profile pieces 5B" and 5B'", which are connected to one another by the connecting pieces 5C'" and 5C"". The middle row 5H' and the outer row 5H" thus have a common profile piece 5B". Compared to the connecting pieces 5C' and 5C", the connecting pieces 5C'" and 5C"" are fastened on the profile piece 5B" by means of screws (not shown) in a manner slightly offset to the rear. As a result, the outer row 5H" is arranged offset from the middle row 5H' in the receiving frame 5.

In this embodiment, the region below the interspace 5I and the inner row 5H is additionally closed towards the front by a cover element (cover sheet) 5D'.

FIG. 3A shows a schematic view of an embodiment of a receiving frame 5 according to the invention with one row 5H. In this simplest embodiment of the receiving frame 5 according to the invention, only one row 5H is present, which is bounded by profile pieces 5B and 5B' which, in turn, are connected to one another by the connecting pieces 5C and 5C' via screws (not shown). The fastening means 5A and 5A' are arranged on the profile piece 5B via screws (not shown), by means of which the receiving frame 5 can be connected to a platen 3 (not shown here) to form an interspace 5I.

FIG. 3B shows a schematic view of an embodiment of a receiving frame 5 according to the invention with two rows 5H, 5H'. In this embodiment of the receiving frame 5 according to the invention, an inner row 5H is present, which is delimited by profile pieces 5B and 5B' which, in turn, are connected to one another by the connecting pieces 5C and 5C' via screws (not shown). The fastening means 5A and 5A' are arranged on the profile piece 5B via screws (not shown), by means of which the receiving frame 5 can be connected to a platen 3 (not shown here) to form an interspace 5I.

Connecting pieces 5C" and 5C'" are furthermore fastened on the profile piece 5B' via screws (not shown). The inner row 5H and the outer row 5H' thus have a common profile piece 5B'. Compared to the connecting pieces 5C and 5C', the connecting pieces 5C" and 5C'" are fastened on the profile piece 5B' by means of screws (not shown) in a manner slightly offset to the rear. As a result, the outer row 5H' is arranged offset from the inner row 5H in the receiving frame 5. The outer row 5H' is outwardly bounded by the profile piece 5B". Connecting pieces 5C" and 5C'" are also fastened on the profile piece 5B" via screws (not shown).

FIG. 3C shows a schematic view of an embodiment of a receiving frame 5 according to the invention with three rows 5H, 5H', 5H". Compared to the embodiment according to FIG. 3B, an additional row 5H" is provided, which is formed in an analogous manner by additional connecting pieces 5C"" and 5C"""" and the additional profile piece 5B'". The connecting pieces 5C"" and 5C"""" are fastened on the profile pieces 5B" and 5B'" via screws (not shown). The middle row 5H' and the outer row 5H" thus also have a common profile piece 5B". Compared to the connecting pieces 5C" and 5C'", the connecting pieces 5C"" and 5C"""" are fastened on the profile piece 5B" by means of screws (not shown) in a manner slightly offset to the rear. As a result, the middle row 5H' is arranged offset from the outer row 5H" in the receiving frame 5. The outer row 5H" is outwardly bounded by the profile piece 5B'".

The embodiment shown in FIG. 3D differs from the embodiment shown in FIG. 3C in that the profile piece 5B" is shortened and does not extend down to the connecting pieces 5C'" and 5C"""". Below the intermediate pieces 5E and 5E', the interior spaces of the middle and outer rows 5H', 5H" are thus combined and suitable for receiving larger energy modules.

FIG. 4 shows a schematic view of a further embodiment of a receiving frame 5 according to the invention. This embodiment is characterized by the fastening means 5A being elongated and additionally extending over the inner row 5H of the receiving frame 5. The fastening means 5A here takes on the additional function of a connecting piece and is fastened on the profile piece 5B via screws (not shown). FIG. 4 additionally shows rails 5F and 5F' which serve to receive energy modules. Otherwise, the structure of this embodiment corresponds to the structure shown in FIG. 2.

FIG. 5 is a top view of an embodiment of a receiving frame 5 according to the invention having offset rows 5H, 5H'. Analogously to FIGS. 2 to 4, the connecting pieces 5C and 5C" are fastened on the profile piece 5B' in a manner offset from one another, namely by distance X. X is preferably 10-100 mm, particularly preferably 30-70 mm FIG. 5 shows the screws 5G, 5G', 5G" and 5G'", by means of which the connecting pieces 5C and 5C" are connected to the profile pieces 5B, 5B' and 5B".

The invention claimed is:

1. A die casting machine comprising:

at least one receiving frame for energy modules (4A, 4B, 4C, 4D, 4E, 4F), the at least one receiving frame comprising:

fastening means (5A, 5A') for fastening the at least one receiving frame on the die casting machine, 1 to 3 rows (5H, 5H', 5H") for receiving the energy modules (4A, 4B, 4C, 4D, 4E, 4F), wherein each of the 1 to 3 rows (5H, 5H', 5H") comprises two profile pieces (5B, 5B', 5B", 5B'") which are connected to one another, at their ends, by a connecting piece (5C, 5C', 5C", 5C'", 5C"", 5C"""") or one of the energy modules (4E), forming a quadrangular interior space, wherein the 1 to 3 rows (5H, 5H', 5H") have means for arranging the energy modules (4A, 4B, 4C, 4D, 4E, 4F) in their interior space and, when there is a plurality of rows, the rows are connected to one another, and wherein the fastening means (5A, 5A') for fastening the at least one receiving frame on the die casting machine are arranged on a profile piece (5B) forming an outer face of the at least one receiving frame (5), and the at least one receiving frame is fastened on the die casting machine (1) via the fastening means (5A, 5A'), forming an interspace (5I) between the die casting machine (1) and a row of the 1 to 3 rows adjacent to the die casting machine (1).

2. The die casting machine according to claim 1, wherein the at least one receiving frame has two fastening means (5A, 5A') which are arranged in an upper or lower quarter of a lateral end of an adjacent row of the 1 to 3 rows (5H, 5H', 5H") and extend laterally from the row (5H).

3. The die casting machine according to claim 1, wherein the 1 to 3 rows (5H, 5H', 5H") in the at least one receiving frame are arranged offset from one another in depth.

4. The die casting machine according to claim 1, wherein adjacent rows of the 1 to 3 rows (5H, 5H', 5H") have a common profile piece (5B', 5B").

5. The die casting machine according to claim 4, wherein at least one of the fastening means (5A, 5A') forms an upper or lower connecting piece of an adjacent row of the 1 to 3 rows (5H, 5H', 5H").

6. The die casting machine according to claim 4, wherein a common profile piece (5B") between adjacent rows of the 1 to 3 rows (5H, 5H', 5H") does not extend over an entire height of the adjacent rows of the 1 to 3 rows (5H, 5H', 5H").

7. The die casting machine according to claim 1, wherein a row (5H) of the 1 to 3 rows (5H, 5H', 5H") adjacent to the fastening means (5A, 5A') has a lower height than at least one further row (5H', 5H").

8. The die casting machine according to claim 1, wherein one or more cover elements (5D, 5D', 5D") can be arranged on the at least one receiving frame on a lower connecting piece (5C, 5C', 5C", 5C"', 5C"", 5C"""") of the 1 to 3 rows (5H, 5H', 5H").

9. The die casting machine according to claim 1, wherein the at least one receiving frame is arranged on a side face of a movable platen of the die casting machine.

10. The die casting machine according to claim 1, wherein the at least one receiving frame includes a pair of receiving frames, the pair of receiving frames are arranged symmetrically on both sides of the die casting machine.

11. The die casting machine according to claim 1, wherein the die casting machine has a platform of a height which can be reached by operating personnel, and the arrangement of at least one of the at least one receiving frame on the die casting machine is aligned with the platform height of the die casting machine.

12. The die casting machine according to claim 1, wherein at least one of the energy modules (4A, 4B, 4C, 4D, 4E, 4F) is arranged in at least one of the 1 to 3 rows (5H, 5H', 5H") of the at least one receiving frame.

13. The die casting machine according to claim 12, wherein at least one of the energy modules (4A, 4B, 4C, 4D, 4E, 4F) is a device for operating hydraulic elements of the die casting machine and is arranged in at least one of the 1 to 3 rows (5H) of the at least one receiving frame adjacent to the die casting machine.

14. The die casting machine according to claim 12, wherein each energy module (4A, 4B, 4C, 4D, 4E, 4F) is arranged in at least one of the 1 to 3 rows (5H, 5H', 5H") of the at least one receiving frame as close as possible to the die casting machine.

15. The die casting machine according to claim 1, wherein it is a two-platen die casting machine or a three-platen die casting machine.

* * * * *